US008544291B2

(12) United States Patent
Kim et al.

(10) Patent No.: US 8,544,291 B2
(45) Date of Patent: Oct. 1, 2013

(54) REFRIGERATOR

(75) Inventors: Dong Jeong Kim, Seoul (KR); Seong Jae Kim, Seoul (KR); Kyung Han Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 798 days.

(21) Appl. No.: 12/522,386

(22) PCT Filed: Jan. 18, 2008

(86) PCT No.: PCT/KR2008/000314

§ 371 (c)(1),
(2), (4) Date: Jul. 8, 2009

(87) PCT Pub. No.: WO2008/088184

PCT Pub. Date: Jul. 24, 2008

(65) Prior Publication Data

US 2009/0301126 A1 Dec. 10, 2009

(30) Foreign Application Priority Data

Jan. 18, 2008 (KR) ..... 10-2007-0005519

(51) Int. Cl.
*F25D 3/00* (2006.01)

(52) U.S. Cl.
USPC ..... 62/391; 62/389

(58) Field of Classification Search
USPC ..... 62/389, 344, 377, 391, 398, 434, 62/438; 222/146.6, 108, 533
See application file for complete search history.

(56) References Cited

U.S. PATENT DOCUMENTS

| | | | | |
|---|---|---|---|---|
| 2,229,850 | A | 1/1941 | Hoskins | |
| 3,232,489 | A | 2/1966 | Buffington | |
| 4,227,383 | A * | 10/1980 | Horvay | 62/344 |
| 6,442,954 | B1 * | 9/2002 | Shapiro et al. | 62/137 |
| 6,648,187 | B1 * | 11/2003 | Shypkowski | 222/527 |
| 6,679,082 | B1 * | 1/2004 | Tunzi | 62/344 |
| 6,904,765 | B2 * | 6/2005 | Lee et al. | 62/320 |
| 7,007,500 | B2 * | 3/2006 | Lee | 62/389 |
| 7,017,353 | B2 * | 3/2006 | Gist et al. | 62/73 |
| 7,048,129 | B2 * | 5/2006 | Skillings | 210/424 |
| 7,316,121 | B2 * | 1/2008 | Lee et al. | 62/344 |
| 7,469,553 | B2 * | 12/2008 | Wu et al. | 62/344 |
| 8,109,112 | B2 * | 2/2012 | Smith et al. | 62/344 |

(Continued)

FOREIGN PATENT DOCUMENTS

| | | |
|---|---|---|
| EP | 0449061 A2 | 10/1991 |
| EP | 1519131 A1 | 3/2005 |

(Continued)

OTHER PUBLICATIONS

Korean Notice of Allowance dated Nov. 14, 2007 for Application No. 10-2007-0005519, with English translation 3 pages.

(Continued)

*Primary Examiner* — Allana Lewin
*Assistant Examiner* — Dawit Muluneh
(74) *Attorney, Agent, or Firm* — Fish & Richardson P.C.

(57) ABSTRACT

The present invention relates to refrigerators. More specifically, the present invention relates to a refrigerator which has a residue tray for holding residue of water or ice from a dispenser when the dispenser is pushed in the door, thereby permitting to make simple and effective disposing of the residue of water or ice from the dispenser in the door.

14 Claims, 9 Drawing Sheets

(56) References Cited

U.S. PATENT DOCUMENTS

| | | | | |
|---|---|---|---|---|
| 2004/0183414 | A1* | 9/2004 | Kwon | 312/401 |
| 2004/0187516 | A1* | 9/2004 | Lee | 62/389 |
| 2005/0056043 | A1* | 3/2005 | Lee et al. | 62/344 |
| 2005/0072178 | A1* | 4/2005 | Park et al. | 62/389 |
| 2010/0071401 | A1* | 3/2010 | Jang et al. | 62/391 |

FOREIGN PATENT DOCUMENTS

| | | | |
|---|---|---|---|
| JP | 08-226735 | A | 9/1996 |
| JP | 2000-085891 | A | 3/2000 |
| KR | 2001-0048927 | A | 6/2001 |
| KR | 2004-013820 | A | 2/2004 |
| KR | 10-20050028360 | | 3/2005 |
| KR | 2005-0022804 | A | 3/2005 |
| KR | 1020040005424 | * | 8/2005 |

OTHER PUBLICATIONS

International Search Report and Written Opinion dated Nov. 11, 2008 for Application No. PCT/KR2008/000314, 10 pages.

* cited by examiner

REFRIGERATOR

CROSS REFERENCE TO RELATED APPLICATIONS

This application is a U.S. National Phase Application under 35 U.S.C. § 371 of International Application PCT/KR2008/000314, filed on Jul. 24, 2008, which claims the benefit of Korean Application No. 10-2007-0005519, filed on Jul. 24, 2008.

TECHNICAL FIELD

The present invention relates to refrigerators. More specifically, the present invention relates to a refrigerator which disposes residue of water or ice from a dispenser in an inside of a door.

BACKGROUND ART

In general, the refrigerator, having a refrigerating chamber and a freezing chamber, stores food. The refrigerating chamber is maintained at about 3~4° C. for making long time fresh storage of the food, and the freezing chamber is maintained at a sub-zero temperature for making frozen state storage of food.

Recently, besides main functions of refrigerating and freezing, the refrigerators have various functions added thereto. Of the refrigerators, a refrigerator having a dispenser mounted to a door thereof for dispensing water or ice is widely spotlighted.

FIG. 1 illustrates a perspective view of a related art refrigerator having a dispenser mounted thereto.

Referring to FIG. 1, in general, the related art refrigerator 101 having a dispenser 110 mounted thereto has the dispenser 110 mounted in an inside of a door 105. The refrigerator door 105 having the dispenser 110 mounted thereto is recessed for use as a cup receiving space S.

On an upper side of the cup receiving space S, there is a chute 115 projected from a top of the space for dispensing water or ice, and on one side of the chute 115, there is a lever 117 for moving the chute 115. Accordingly, if the lever 117 is pressed, the chute 115 dispenses the water and ice.

On a lower side of the cup receiving space S, there is a tray 130 for placing the cup thereon or holding residue of the water or ice from the chute 115.

If a certain amount of the residue is filled in the tray 130, the residue is disposed by detaching the tray 130 from the cup receiving space S, emptying the residue, and mounting the tray 130 to the cup receiving space S again.

DISCLOSURE OF INVENTION

Technical Problem

However, the related art refrigerator having the dispenser mounted to the door is liable to make an exterior of the refrigerator poor due to the recess in the door, and has limitation in view of utilization of an inside space of the door.

Technical Solution

To solve the problems, a refrigerator may be taken into consideration, in which the dispenser is pushed into/drawn out of the door.

For an example, the dispenser is drawn out of the door when in use, and pushed into the door when not in use such that a cover of the dispenser is flush with an outside surface of the door.

However, in this case, if the dispenser is pushed into the door after dispensing the water and ice, residue of the water and ice left at the chute drops down to an inside of the door, causing to require to dispose the residue.

Accordingly, an object of the present invention is to provide a refrigerator which can dispose residue of water and ice discharged to an inside of the door from the dispenser by a simple and effective method.

To achieve these objects and other advantages and in accordance with the purpose of the invention, as embodied and broadly described herein, a refrigerator includes a dispenser secured to a door such that the dispenser can be pushed in/drawn out of the door for dispensing water or ice, and a residue tray detachably secured to one side of the door for holding residue of the water or ice from the dispenser when the dispenser is pushed in the door.

The refrigerator may further include a residue guiding member below the dispenser for guiding the residue from the dispenser to the residue tray.

Preferably, the residue guiding member may include a residue receiver for receiving the residue from the dispenser, and a guide tube having one end connected to the residue receiver and the other end connected to the residue tray for guiding the residue to the residue tray.

Preferably, the residue guiding member includes a sloped surface which is sloped for flow down of the residue.

The refrigerator may further include a supporting holder detachably secured to one side of the door for supporting the residue tray.

The residue tray may be secured to an inside surface of the door.

The residue tray can be pushed into/drawn out of the inside of the door.

The residue tray has an exposed surface flush with an outside surface of the door when the residue tray is pushed in the door.

In another aspect of the present invention, a refrigerator includes a door for opening/closing a refrigerator body having a holding space therein, a dispenser secured to a door such that the dispenser can be pushed in/drawn out of the door for dispensing water or ice, a residue guiding member below the dispenser for guiding residue of the water or ice from the dispenser when the dispenser is pushed in the door, and a residue tray in the refrigerator body for holding the residue from the residue guiding member when the door is closed.

In another aspect of the present invention, a refrigerator includes a dispenser secured to a door such that the dispenser can be pushed in/drawn out of the door for dispensing water or ice, and a residue tray to be pushed in/drawn out of the door interlocked with movement of the dispenser when the dispenser is pushed in/drawn out of the door for holding residue of the water or ice from the dispenser.

Advantageous Effects

The refrigerator of the present invention has following advantageous effects.

First, the residue from the dispenser discharged to an inside of the door can be disposed simply and effectively.

Second, even if the residue tray is mounted to the door or the refrigerator body, the residue can be disposed while an exterior of the door is kept to look good.

Third, the transparent material of the residue tray permits to notice an amount of the residue in the residue tray easily, and the residue tray can be mounted to the door easily again after detaching the residue tray from the door and the residue is thrown away.

Fourth, because the residue tray can be pushed in/drawn out of the door, the residue from the dispenser in the door can be disposed, the residue can be disposed when the dispenser is exposed to an outside of the door, and a cup or the like can be placed on the residue tray.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

DESCRIPTION OF SYMBOLS ON KEY PARTS IN THE DRAWINGS

Figure 1:
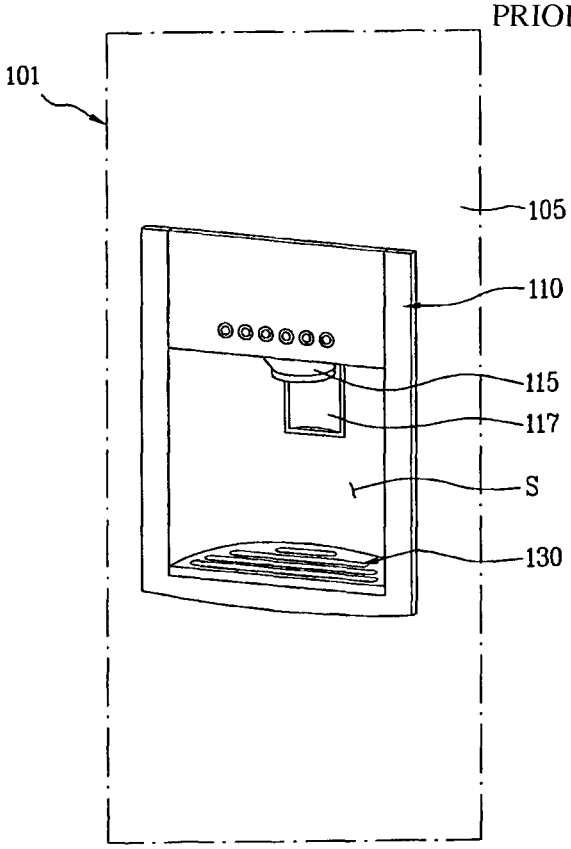
Fig. 1 PRIOR ART
FIG. 1 illustrates a perspective view of a related art refrigerator having a dispenser mounted thereto.

1: refrigerator
3: refrigerator body
5: door
6: holding box
10 dispenser
11: cover
15: chute
20 residue tray
30 residue guiding member
31: residue receiver
32: sloped surface
33: guiding tube
34: drain hole
35: stopper
40 supporting holder

MODE FOR THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 2:
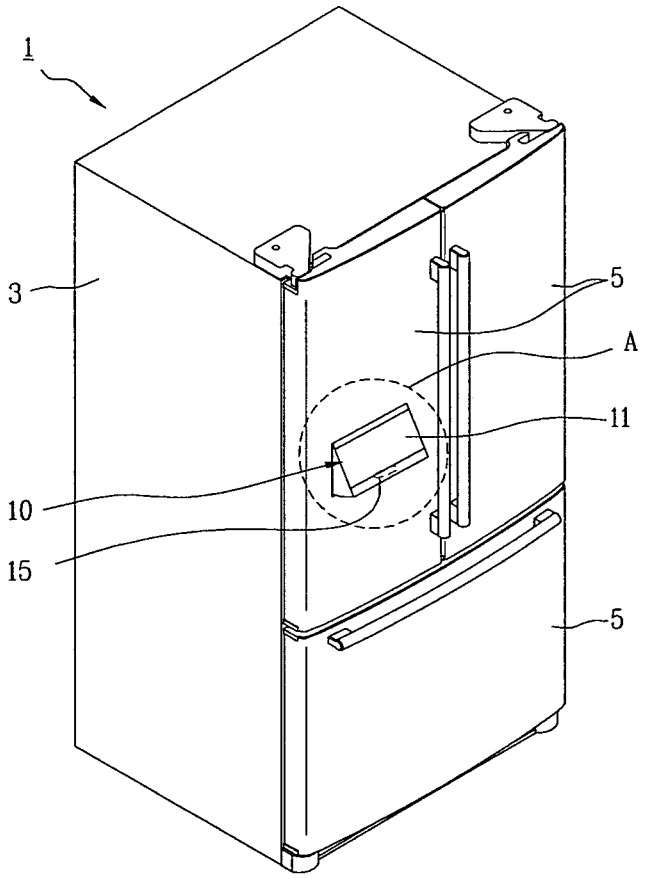
FIG. 2 illustrates a perspective view of a refrigerator in accordance with a preferred embodiment of the present invention.

FIG. 2 illustrates a perspective view of a refrigerator in accordance with a first preferred embodiment of the present invention.

Referring to FIG. 2, the refrigerator 1 includes a refrigerator body 3 having a holding space therein, a door 5 for opening/closing the refrigerator body 3, a dispenser 10 mounted to the door 5.

The holding space in the refrigerator body 3 may be divided into a refrigerating chamber and a freezing chamber, and for opening/closing respective spaces, the refrigerator body 3 may have three doors 5 like the embodiment. The dispenser 10 is mounted to at least one of the three doors 5.

The dispenser 10, for dispensing water or ice, is mounted such that the dispenser 10 can be pushed in/drawn out of the door 5. The dispenser 10 is provided with a cover 11 which forms an exterior thereof for making an outside surface of the dispenser 10 flush with an outside surface of the door 5 when the dispenser 10 is pushed into the door 5, and a chute 15 on an inside of the cover 11 for guiding the water and ice to an outside of the refrigerator 1.

Of course, the dispenser 10 may have two chutes spaced from each other so that the water and ice is dispensed separately. However, in the embodiment, a dispenser 10 which can dispense the water or ice from one chute 15 will be described for convenience of description.

Figure 3:
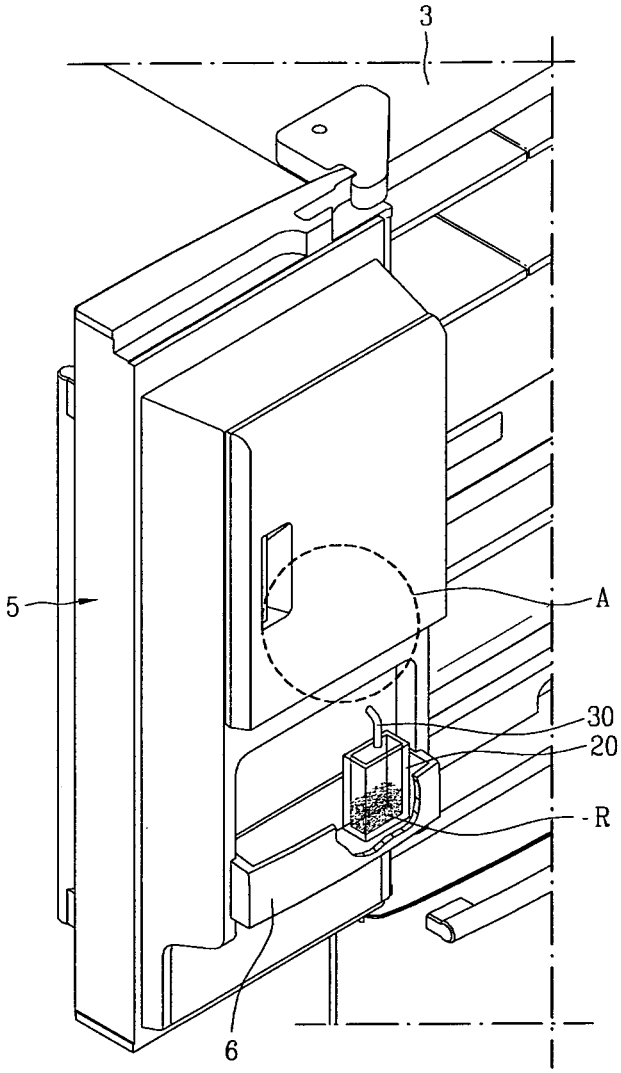
FIG. 3 illustrates a perspective view of the refrigerator having the door in FIG. 2 opened.

Referring to FIG. 3, when in use, the dispenser 10 is drawn out of the door 5, and pushed into the door 5 such that the cover 11 of the dispenser 10 is flush with the outside surface of the door 5.

In this instance, the dispenser 10 may be pushed into/drawn out of the door 5 by a mechanical method in which the cover 11 on the dispenser 10 is pressed down with a hand, to release locking thereof such that the dispenser 10 is drawn out of the door 5, or by an automatic method in which a button (not shown) on an outside of the refrigerator is pushed to release locking thereof such that the dispenser 10 is drawn out of the door 5.

When the dispenser 10 is in use, the dispenser 10 is drawn out of the door 5, to dispense the water or ice according to user's need, selectively.

In the meantime, after the dispenser 10 is used, the dispenser 10 is pushed into the door 5 again. In this case, since the residue R of the water or ice is liable to drop from the chute 15 to, and held in, the inside of the door 5, a requirement arises for disposing the residue R.

Accordingly, the refrigerator 1 of the present invention is provided with a residue tray 20 for holding the residue, and a residue guiding member 30 for guiding the residue R of the water or ice from the dispenser 10 to the inside of the door 5.

FIG. 3 illustrates a perspective view of the refrigerator having the door in FIG. 2 opened.

Referring to FIG. 3, the residue tray 20 is attached to an inside surface of the door 5. In more detail, the residue tray 20 is detachably mounted to a lower holding box 6 in the door 5 adjacent to the refrigerator body 3. In this instance, the lower holding box 6 may be a general holding box for holding drinks or the like. Of course, a supporting holder may be provided and attached to the inside of the door 5 for placing the residue tray 20 thereon.

The residue tray 20 may be a container having an opened top as the embodiment, or a partially opened top.

It is preferable that the residue tray 20 is formed of a transparent material, for easy notice of an amount of the residue R therein. Therefore, if the residue R is filled in the residue tray 20 to a certain amount, the user 5 may detach the residue tray 20 from the door 5, and throw away the residue R.

Figure 4:
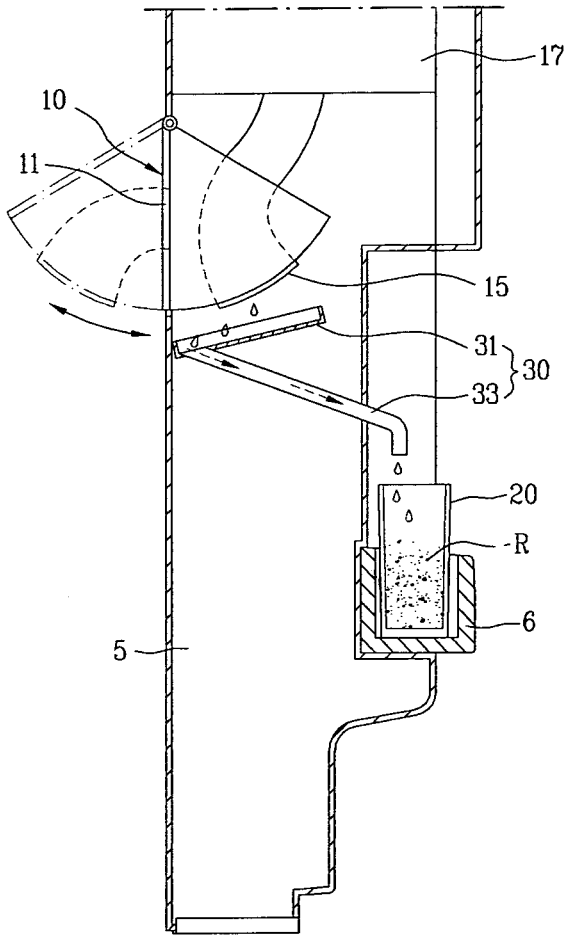
FIG. 4 illustrates a longitudinal section of an A area in FIG. 3, schematically.
Figure 5:
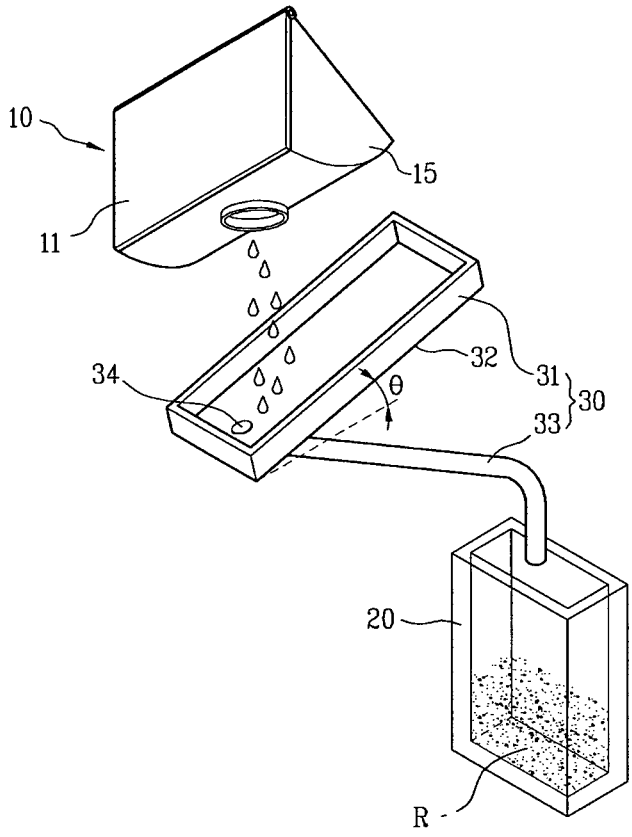
FIG. 5 illustrates a perspective view of major parts in FIG. 4, schematically.

FIG. 4 illustrates a longitudinal section of an A area in FIG. 3 schematically, and FIG. 5 illustrates a perspective view of major parts in FIG. 4, schematically.

Referring to FIG. 4, there may be a residue guiding member 30 mounted to an upper side of the residue tray 20 for guiding the residue R of the water or ice from the chute 15 of the dispenser 10 to the residue tray 20.

The residue guiding member 30 includes a residue receiver 31 for receiving the residue R from the chute 15, and a guide tube 33 for guiding the residue from the residue receiver 31 to the residue tray 20.

Referring to FIG. 5, the residue receiver 31 serves to receive the residue R from the chute 15, and guide the residue to the guiding tube 33. The residue receiver 31 is arranged under the chute 15, and has a drain hole 34 in a lower portion connected to the guiding tube 33.

Because, even if the reside R collected on the residue receiver 31 contains ice, the ice melts during the ice stays on the residue receiver 31, the residue R can move to the guide tube 33 through the drain hole 45.

The residue receiver 31 has a sloped surface 32 for enabling the residue R to move down. According to this, as the residue R is collected to the drain hole 34 following the sloped surface 32 of the residue receiver 31, the residue R can be guided to the guiding tube 33, easily.

Of course, such a sloped surface 32 can be formed to level to the residue receiver 31, and the residue receiver 31 can be tilted with respect to a horizontal plane of the door 5 to form the sloped surface. A slope angle q of the sloped surface 32 can be adjusted as necessary.

The guiding tube 33 may be a hollow tube, having one end connected to the drain hole 34 of the residue receiver 31 and the other end lead to the residue tray 20. According to this, the residue R is collected to the residue receiver 31, and flows along the guiding tube 33, and drops into the residue tray 20.

Thus, as the residue R of the water and ice from the chute 15 to the inside of the door 5 is collected, and guided to, and held in, the residue tray 20 by the residue guiding member 30, the residue R from the inside of the door 5 can be disposed, easily.

Moreover, since the residue tray 20 is formed of the transparent material, the amount of the residue R can be noticed easily, and since the residue tray 20 is detachable from the door 5, the residue tray 20 can be attached to the door 5 after the residue is thrown away.

Figure 6:
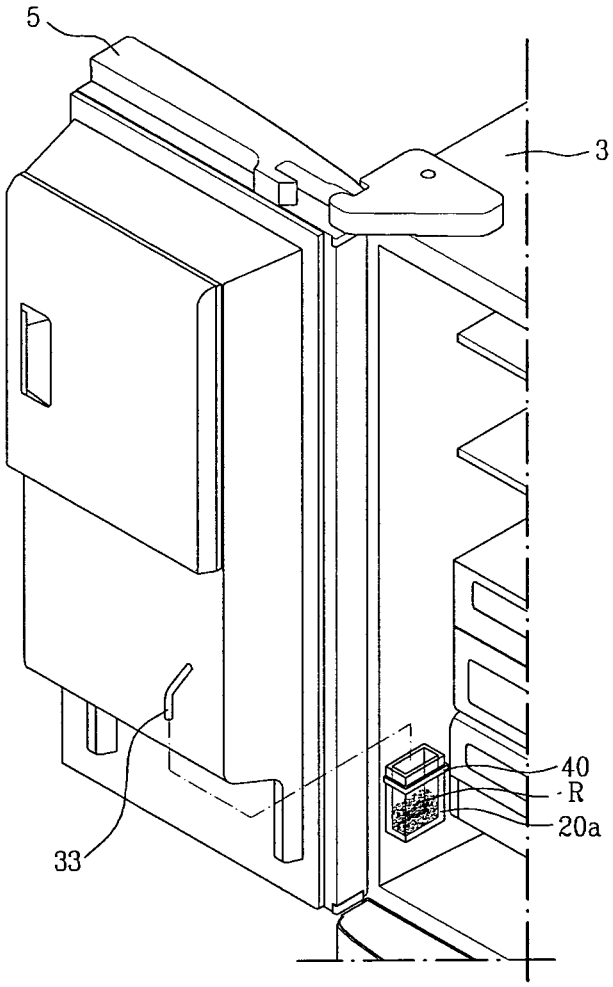
FIGS. 6 and 7 illustrate diagrams of refrigerators in accordance with a second preferred embodiment of the present invention, respectively.
Figure 7:
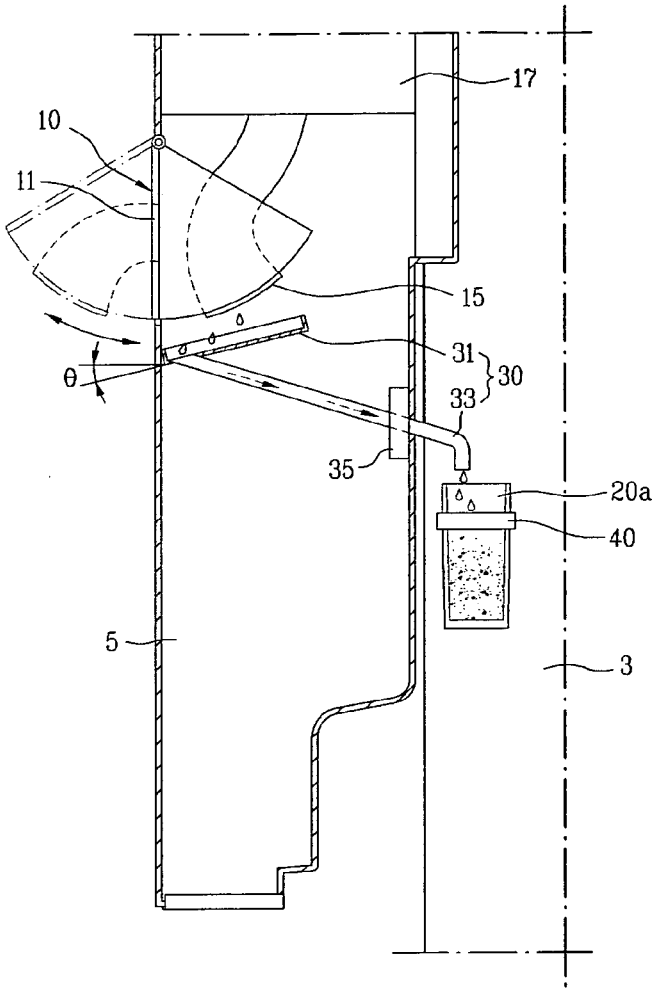

FIGS. 6 and 7 illustrate diagrams of refrigerators in accordance with a second preferred embodiment of the present invention, respectively.

Only parts of the embodiment different from the foregoing embodiment will be described, and description of identical parts will be omitted.

Referring to FIG. 6, in the embodiment, a residue tray 20*a* is mounted to an inside of the refrigerator body 3. Though the residue tray 20*a* may be placed in the receiving space of the refrigerator body 3 directly, in the embodiment, a supporting holder 40 is provided additionally for supporting the residue tray 20*a*.

The supporting holder 40 may be detachably, or rotatably mounted to the inside of the refrigerator body 3. If the residue tray 20*a* supported on the supporting holder 40 interferes other food or the like intended to put in the receiving space of the refrigerator body 3, the supporting holder 40 may be removed from the refrigerator body 3 or rotated for avoiding the interference.

Referring to FIG. 7, the residue tray 20*a* in the refrigerator body 3 receives the residue R from the residue guiding member 30 when the door 5 is closed.

Though the residue guiding member 30 is identical to the residue guiding member in the foregoing embodiment, there is a stopper 35 on one side of the guiding tube 33.

The stopper 35 blocks the guiding tube 33 selectively depending on closing/opening of the door 5. That is, in a door 5 close state, the stopper 35 opens the guiding tube 33, to permit the residue R to flow from the guiding tube 33 to the residue tray 20*a*. Opposite to this, in a door 5 open state, the stopper 35 blocks the guiding tube 33, to prevent the residue R from dropping from the guiding tube 33.

The stopper 35 may be a solenoid valve, or the like.

Figure 8:
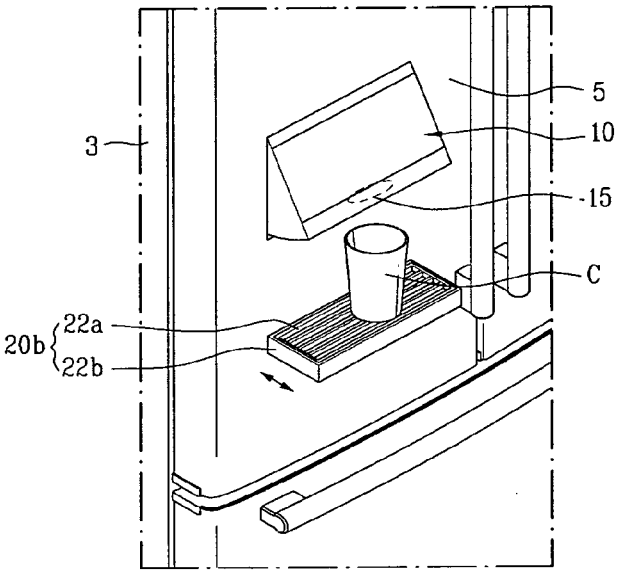
FIGS. 8 to 10 illustrate diagrams of refrigerators in accordance with a third preferred embodiment of the present invention, respectively.
Figure 9:
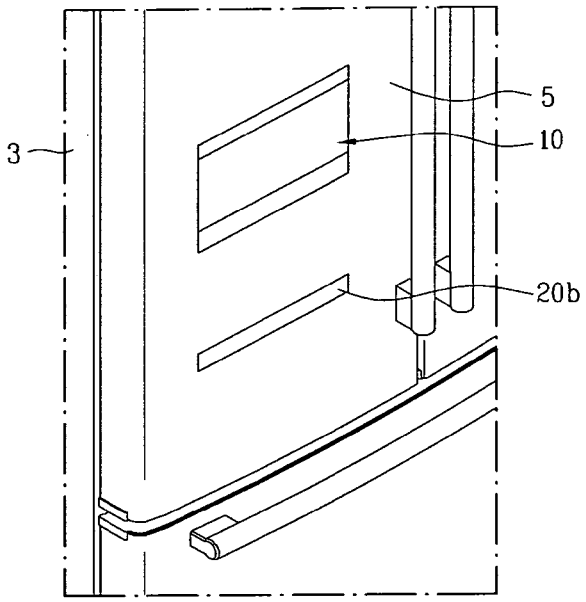
Figure 10:
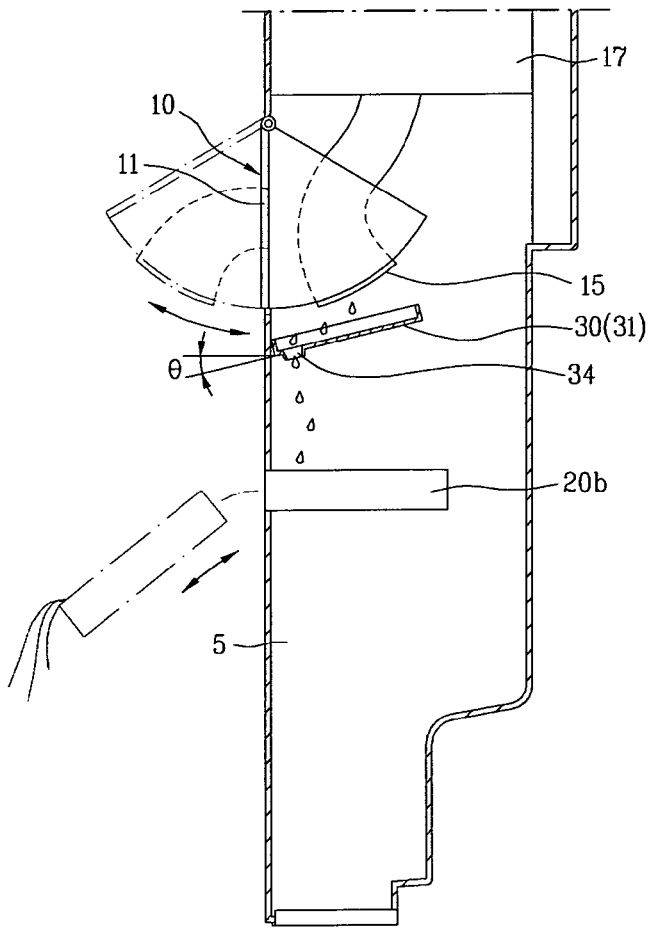

FIGS. 8 to 10 illustrate diagrams of refrigerators in accordance with a third preferred embodiment of the present invention, respectively.

Only parts of the embodiment different from the foregoing embodiment will be described, and description of identical parts will be omitted.

Referring to FIG. 8, the residue tray 20*b* can be pushed in/drawn out of the door 5 as shown in arrows. The residue tray 20*b* may include a tray body 22*b* for holding the residue R, and a tray cover 22*a* detachably mounted to the tray body 22*b*. It is preferable that the tray cover 22*a* has drain holes passed therethrough for pass of the residue R.

Referring to FIG. 10, when the residue tray 20*b* is pushed in the door 5, the residue tray 20*b* receives the residue R in the door 5, and, as shown in FIG. 8, when the residue tray 5 is drawn out of the door 5, a cup C or the like is placed thereon for receiving the water or ice from the chute 15.

An action of pushing the residue tray 20*b* into or drawing the residue tray 20*b* out of the door 5 may be independent from, or interlocked with, an action of pushing the dispenser 10 into or drawing the dispenser 10 out of the door 5. That is, it can be made that, when the dispenser 10 is drawn out of the door 5, the residue tray 20*b* is also drawn out of the door 5 interlocked with a drawing out action of the dispenser 10.

Referring to FIG. 9, when the dispenser 10 is pushed into the door 5, the residue tray 20*b* is also pushed into the door 5. In this instance, alike the foregoing embodiment, the residue tray 20*b* receives the residue R from the door 5 discharged from the chute 15. If the residue R is filled in the residue tray 20*b* to a certain amount, the residue tray 20*b* is drawn out of the door 5, and separates from the door 5, and the residue R may be thrown away.

When the residue tray 20*b* is pushed in the door 5, an exposed surface of the residue tray 20*b* is flush with an outside surface of the door 5. According to this, the exterior of the door 5 looks good.

Referring to FIG. 10, the embodiment is identical to the foregoing embodiment in that there is the residue guiding member 30 above the residue tray 20*b* for guiding the residue R of the water or ice from the dispenser 10, i.e., the chute 15, to the residue tray 20*b*.

However, though the residue guiding member 30*b* includes the residue receiver 31 for receiving the residue R from the chute 15, the residue guiding member 30*b* does not include the guiding tube 33. According to this, after the residue R from the chute 15 is collected at the residue receiver 31, the residue R flows to the residue tray 20*b* through the drain hole 34, directly.

Figure 11:
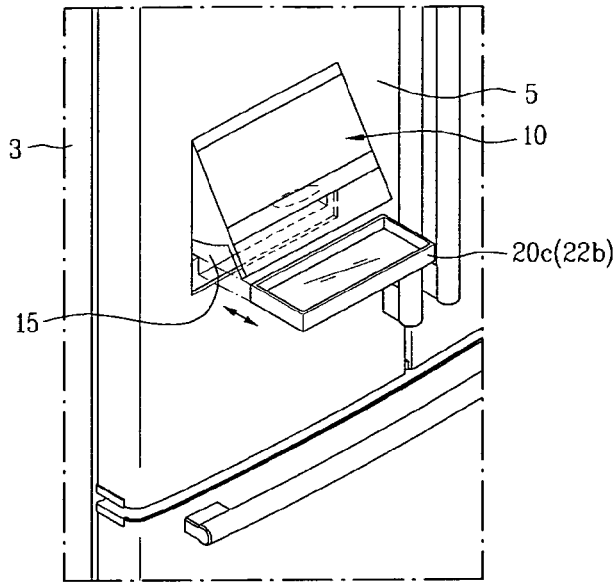
FIGS. 11 and 12 illustrate diagrams of refrigerators in accordance with a fourth preferred embodiment of the present invention, respectively.
Figure 12:
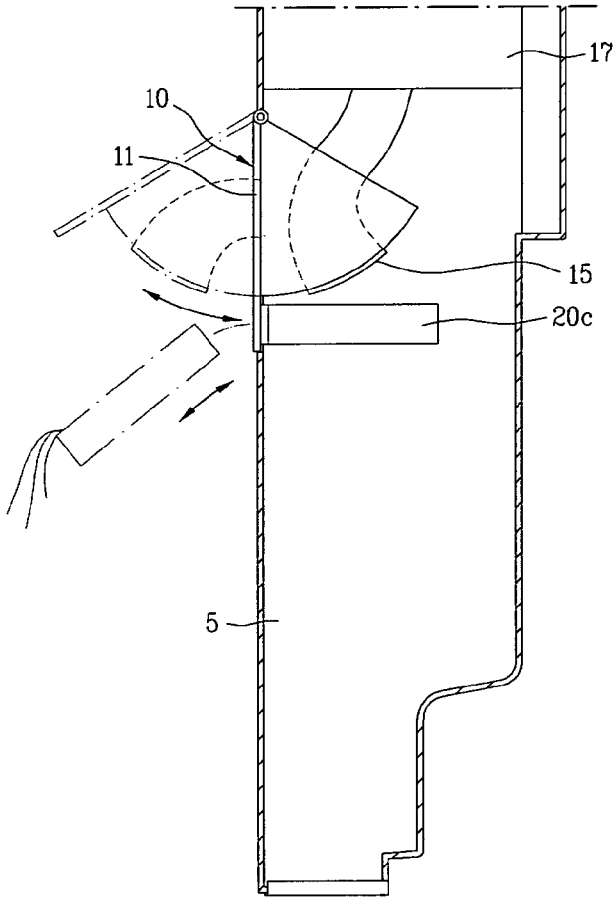

FIGS. 11 and 12 illustrate diagrams of refrigerators in accordance with a fourth preferred embodiment of the present invention, respectively.

Only parts of the embodiment different from the foregoing embodiment will be described, and description of identical parts will be omitted.

Referring to FIG. 11, alike the third embodiment, the residue tray 20*c* of the embodiment is pushed in/drawn out of the door 5 in arrow directions.

However, the residue tray 20*c* is mounted in the door 5, i.e., close to the chute 15 of the dispenser 10 so that an exposed surface of the residue tray 20*c* is covered with a cover 11 of the dispenser 10 when the residue tray 20*c* is pushed in the door 5.

In this instance, the residue tray 20*c* may only include the tray body 22*b* the same as the embodiment so that the tray cover 22*a* the same as the third embodiment does not cover the tray body 22*b*.

It can be made that the residue tray 20*c* may be pushed in/drawn out of the door 5 with a hand personally, or automatically when the residue R is filled in the residue tray 20*c* to a certain amount.

Referring to FIG. 12, there is no residue receiver 30 of the foregoing embodiments on an upper side of the residue tray 20*c* (under the dispenser 10, i.e., the chute 15).

Therefore, the residue R of the water and ice from the chute 15 drops on and held at the residue tray 20*c* directly, and if the residue R is filled in the residue tray 20*c* to a certain amount, the residue tray 20*c* may be taken out of the door 5, and the residue R may be throw away.

An unexplained reference numeral 17 denotes a supply portion for supplying water or ice to the chute 15.

It will be apparent to those skilled in the art that various modifications and variations can be made in the present invention without departing from the spirit or scope of the invention.

That is, though the foregoing embodiments describe refrigerators each having three doors, the present invention can be applied regardless of a number of the doors.

Moreover, though the residue is guided to the residue tray by the residue guiding member in the first, second, or third embodiment, there can be an embodiment like the fourth embodiment in which, no residue guiding member is provided, but the residue is guided from the chute to the residue tray, directly.

Thus, it is intended that the present invention cover the modifications and variations of this invention provided they come within the scope of the appended claims and their equivalents.

INDUSTRIAL APPLICABILITY

The present invention relates to a refrigerator for disposing residue of water or ice from a dispenser in a door, and is applicable to fabrication of refrigerators.

The invention claimed is:

1. A refrigerator comprising:

a dispenser secured to a door such that the dispenser can be pushed in/drawn out of the door for dispensing water or ice, the dispenser comprising:

a cover which defines an exterior of the dispenser, the cover being pivotable on a horizontal pivot shaft provided on the door, and a chute located on an inside of the cover and configured to guide the water or ice to an outside of the refrigerator, the cover being pivoted out from the door to expose the chute to the outside of the refrigerator and being pivoted toward the door to shield the chute from the outside of the refrigerator and make an outside surface of the dispenser flush with an outside surface of the door;

a residue tray detachably secured to one side of the door for holding residue of the water or ice that escapes from the chute of the dispenser when the dispenser is pushed in the door; and a residue guiding member that is located within the door such that the residue guiding member is covered by the outside surface of the door, that is positioned below the chute of the dispenser when the dispenser is pushed in the door and the cover shields the chute from the outside of the refrigerator, and that guides, to the residue tray, residue escaping from the chute of the dispenser when the dispenser is pushed in the door and the cover shields the chute from the outside of the refrigerator, wherein the residue guiding member is configured to receive the residue escaping from the chute of the dispenser and guide the received residue from an inside of the door to a rear outside of the door, the rear outside of the door being a side of the door opposite of the cover.

2. The refrigerator as claimed in claim 1, wherein the residue guiding member includes:

a residue receiver for receiving the residue from the dispenser, and a guide tube having a first end connected to the residue receiver and a second end connected to the residue tray for guiding the residue to the residue tray.

3. The refrigerator as claimed in claim 1, wherein the residue guiding member includes a sloped surface which is sloped for flow down of the residue.

4. The refrigerator as claimed in claim 1, further comprising a supporting holder detachably secured to one side of the door for supporting the residue tray.

5. The refrigerator as claimed in claim 1, wherein the residue tray is secured to an inside surface of the door.

6. A refrigerator comprising:

a door for opening/closing a refrigerator body having a holding space therein;

a dispenser secured to a door such that the dispenser can be pushed in/drawn out of the door for dispensing water or ice, the dispenser comprising:

a cover which defines an exterior of the dispenser, the cover being pivotable on a horizontal pivot shaft provided on the door, and a chute located on an inside of the cover and configured to guide the water or ice to an outside of the refrigerator, the cover being pivoted out from the door to expose the chute to the outside of the refrigerator and being pivoted toward the door to shield the chute from the outside of the refrigerator and make an outside surface of the dispenser flush with an outside surface of the door;

a residue guiding member that is located within the door such that the residue guiding member is covered by the outside surface of the door, that is positioned below the chute of the dispenser when the dispenser is pushed in the door and the cover shields the chute from the outside of the refrigerator, and that guides residue of the water or ice that escapes from the chute of the dispenser when the dispenser is pushed in the door and the cover shields the chute from the outside of the refrigerator; and a residue tray in the refrigerator body for holding the residue from the residue guiding member when the door is closed, wherein the residue guiding member is configured to receive the residue escaping from the chute of the dispenser and guide the received residue from an inside of the door to a rear outside of the door, the rear outside of the door being a side of the door opposite of the cover.

7. The refrigerator as claimed in claim 6, wherein the residue guiding member includes:

a residue receiver for receiving the residue from the dispenser, and a guiding tube having a first end connected to the residue receiver and a second end connected to the residue tray for guiding movement of the residue.

8. The refrigerator as claimed in claim 7, wherein the residue guiding member further includes a stopper for blocking the guiding tube depending on opening/closing of the door, selectively.

9. The refrigerator as claimed in claim 6, further comprising a supporting holder detachably or rotatably secured to the inside of the refrigerator body for supporting the residue tray.

10. The refrigerator as claimed in claim 1, wherein the residue guiding member guides the residue escaping from the chute of the dispenser through an inner surface of the door, the inner surface of the door being a surface of the door exposed to an interior of the refrigerator when the door is closed.

11. The refrigerator as claimed in claim 10, wherein the residue tray is located at the inner surface of the door and is configured to receive and retain the residue guided by the residue guiding member through the inner surface of the door.

12. The refrigerator as claimed in claim 1, wherein the residue guiding member first guides the residue escaping from the chute of the dispenser in a first direction toward the outside surface of the door and then guides the residue escaping from the chute of the dispenser in a second direction toward an inner surface of the door, the inner surface of the door being a surface of the door exposed to an interior of the refrigerator when the door is closed.

13. The refrigerator as claimed in claim 1, wherein the residue guiding member comprises:

a tray configured to catch the residue escaping from the chute of the dispenser when the dispenser is pushed into the door; and a pipe that is configured to receive, through an outlet of the tray, the residue caught by the tray and that is configured to guide the received residue to the residue tray.

14. The refrigerator as claimed in claim 13, wherein the tray is configured to guide the residue in a first direction to the pipe and the pipe is configured to guide the residue in a second direction to the residue tray, the second direction being opposite of the first direction.

* * * * *